United States Patent [19]

Pfarrwaller

[11] 3,973,598

[45] Aug. 10, 1976

[54] LOOM HAVING A CLOTH TAKE-UP SYSTEM

[75] Inventor: Erwin Pfarrwaller, Winterthur, Switzerland

[73] Assignee: Sulzer Brothers Limited, Winterthur, Switzerland

[22] Filed: Apr. 2, 1975

[21] Appl. No.: 564,374

[30] Foreign Application Priority Data

Apr. 5, 1974 Switzerland ..... 4832/74

[52] U.S. Cl. ..... 139/304; 139/308; 139/309

[51] Int. Cl.[2] ..... D03D 49/20

[58] Field of Search ..... 139/309, 304, 307, 308, 139/310, 311, 306, 305, 25–27; 66/149

[56] References Cited

UNITED STATES PATENTS

| | | | |
|---|---|---|---|
| 3,428,095 | 2/1969 | Pfarrwaller | 139/304 |
| 3,612,109 | 10/1971 | Pfarrwaller | 139/304 |
| 3,698,446 | 10/1972 | Miller et al. | 139/308 |
| 3,703,914 | 11/1972 | Freisler | 139/308 |
| 3,710,829 | 1/1973 | Johnson et al. | 139/304 |

*Primary Examiner*—James Kee Chi

*Attorney, Agent, or Firm*—Kenyon & Kenyon Reilly Carr & Chapin

[57] ABSTRACT

The cloth take-up system positively drives the deflecting roller at a transmission ratio in which the roller has a greater peripheral speed than the cloth take-up roller. A gear-type transmission is used to produce a difference of about 5% in the peripheral speeds of the deflecting roller and take-up roller.

2 Claims, 1 Drawing Figure

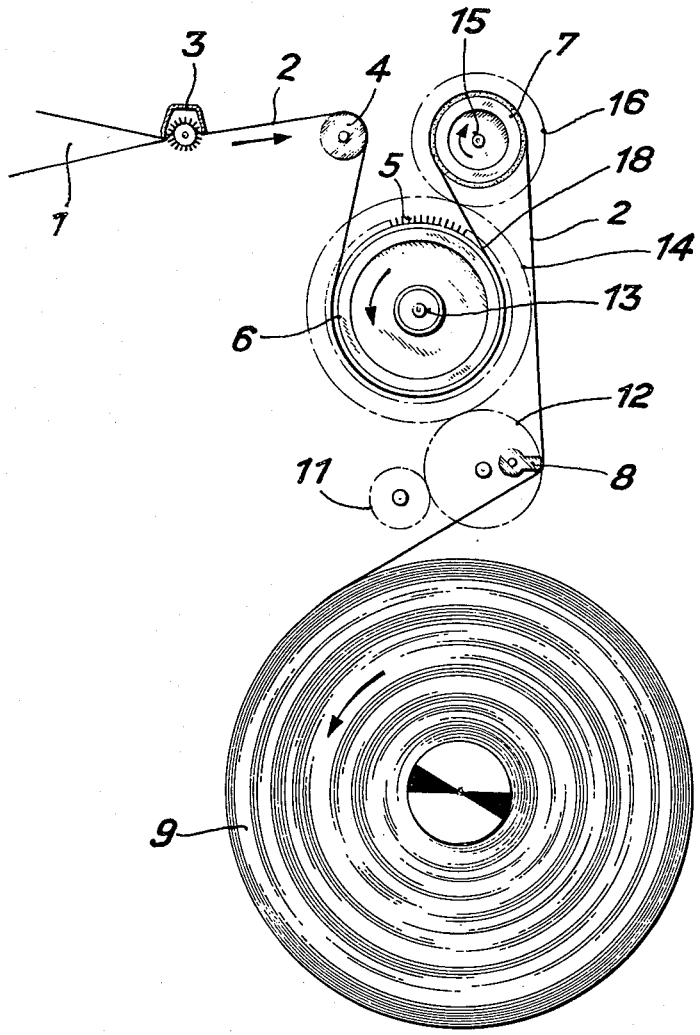
3
2
4
15
7
16
18
5
2
14
1
13
6
12
11
8
9

LOOM HAVING A CLOTH TAKE-UP SYSTEM

This invention relates to a loom having a cloth take-up system.

Heretofore, various types of looms for weaving, for example plain cloth and terry cloth, have been provided with cloth take-up systems in which the produced cloth is taken-up and then wound on a cloth roll. Generally, these take-up systems employ a cloth take-up roller, which may or may not have needles around the periphery, a deflecting roller following the take-up roller and a cloth beam. In some instances, the deflecting roller is driven merely by the movement of the cloth passing over the roller and does not have an independent drive while the cloth beam is driven by way of a slipping clutch. However, in these instances, the fabric may, for some reason, fail to be taken up or deflected by the take-up roller with sufficient uniformity. For instance, the cloth beam and/or the deflecting roller may be stopped temporarily by external factors, such as the machine operators, with the result that the cloth may remain in engagement with the take-up roller over a largerangle of wrap then normal. This raises the possibility of interrupted operation.

Accordingly, it is an object of the invention to insure a uniform take-up of cloth produced in a loom.

It is another object of the invention to avoid snarling of the cloth produced in a loom during take-up.

It is another object of the invention to avoid accidental stops of the deflecting roller of a cloth take-up system of a loom by external forces.

Briefly, this invention provides a cloth take-up system for a loom which includes a cloth take-up roller for receiving a travelling length of cloth, a deflecting roller spaced from the take-up roller downstream of the take-up roller for passage of the cloth thereover and a transmission coupled to the rollers. The transmission drives these rollers at a transmission ratio in which the deflecting roller has a greater peripheral speed than the take-up roller. For example, the transmission drives the deflecting roller at a peripheral speed about five percent (5%) faster than the peripheral speed of the take-up roller.

The invention is particularly valuable in cases in which the cloth take-up roller has needles around its periphery for a terry fabric — i.e. in the case of a terry loom. As experiments have shown, in such a case the greater peripheral speed of the deflecting roller ensures that the cloth is pulled out from the take-up roller needles uniformly and reliably, so that operation is not disturbed by snarling of the cloth. The increased peripheral speed of the deflecting roller also allows a reduction in the take-up torque required at the cloth beam as opposed to known take-up systems. Also, the deflecting roller cannot be accidentally stopped by external factors.

The invention may be carried into practice in various ways but one terry loom and its method of operation in accordance with the invention will now be described by way of example with reference to the accompanying drawing which illustrates a diagrammatic vertical section of the cloth end of the loom, the remainder of which is of conventional construction.

Referring to the drawing, the loom which forms a shed 1 for producing a cloth 2 includes a temple 3 through which the cloth 1 passes to a take-up system. This take-up system includes an undriven deflecting roller 4, a take-up roller 6 which has needles 5 around the periphery when the cloth 2 is a looped or terry fabric, a driven deflecting roller 7 for passage of the cloth therearound, a deflecting bar 8 and a cloth beam 9 downstream of the deflecting roller 7 and bar 8 for winding up the cloth 2. The beam 9 is driven by a slip-clutch (not shown). In addition, the take-up system includes a transmission coupled to the take-up roller 6 and deflecting roller 7 for driving these rollers 6, 7 at a transmission ratio in which the deflecting roller 7 has a greater peripheral speed than the take-up roller 6.

The transmission includes a drive gear 11 which meshes with a gear 12 which is in engagement with a gear 14 secured to a drive shaft 13 of the take-up roller 6. The gear 14, in turn, drives a gear 16 secured to a drive shaft 15 of the deflecting roller 7. In the particular example described, the various gears have the following number of teeth:

| | Number of Teeth |
|---|---|
| Gear 14 | 48 |
| Gear 16 | 28 |

The take-up roller 6 is 149 millimeters (mm) in diameter and the deflecting roller 7 is 91 millimeters (mm) in diameter. The peripheral speed of the deflecting roller 7 is therefore about 5 percent more than that of the take-up roller 6. The cloth 2 is therefore removed from the needles 5 of the take-up roller 6 cleanly and uniformly and separates therefrom along the line 18 where a common tangent to the rollers 6, 7 touches the take-up roller 6.

In operation, the cloth 2 coming from the shed 1 passes through the temple 3 and goes over the undriven deflecting roller 4, to the take-up roller 6. After passing around the take-up roller 6, the cloth 2 passes to the driven deflecting roller 7 and thence, by way of the deflecting bar 8, to the cloth beam 9 driven via the slip clutch (not shown).

The deflecting roller 7 has a rough rubber surface for carrying the cloth 2 thereon.

In a modified construction, the cloth take-up roller 6 has a very rough periphery of corundum or the like instead of needles on the periphery. It is advantageous in this case, too, for the peripheral speed of the deflecting roller 7 to be higher than that of the cloth take-up roller 6, to ensure that the cloth, more particularly a rough cloth e.g. of wool or jute, disengages uniformly from the corundum take-up roller.

Alternatively, the two rollers 6, 7 can be driven intermittently, e.g. by way of a ratchet drive, with the average peripheral speed of the deflecting roller 7 being greater than that of the take-up roller 6.

What is claimed is:

1. A loom having a cloth take-up system including a cloth take-up roller having a plurality of projecting needles on the periphery thereof for receiving a travelling length of cloth, a deflecting roller spaced from said take-up roller downstream thereof for passage of the cloth therearound, a cloth beam downstream of said deflecting roller for winding up of the cloth thereon and a gearing coupling said take-up roller and said deflecting roller together for driving said take-up roller and deflecting roller at a transmission ratio in which said deflecting roller has a greater peripheral speed than said take-up roller.

2. In a cloth take-up system for a loom, the combination of a cloth take-up roller for receiving a travelling length of cloth, a deflecting roller spaced from said take-up roller downstream thereof for passage of the cloth therearound, and a transmission coupled to said take-up roller and said deflecting roller for driving said take-up roller and deflecting roller at a transmission ratio in which said deflecting roller has a greater peripheral speed by about 5 percent than said take-up roller.

* * * * *